US005311885A

United States Patent [19]

Yoshimoto et al.

[11] Patent Number: 5,311,885

[45] Date of Patent: May 17, 1994

[54] EXPANDING APPARATUS FOR AGRICULTURAL PRODUCT SUCH AS TOBACCO MATERIAL

[75] Inventors: Kazuo Yoshimoto; Takashi Ogawa; Hiromi Uematsu; Manabu Takeuchi; Kensuke Uchiyama, all of Hiratsuka, Japan

[73] Assignee: Japan Tobacco Inc., Tokyo, Japan

[21] Appl. No.: 885,963

[22] Filed: May 20, 1992

[30] Foreign Application Priority Data

May 20, 1991 [JP] Japan ..... 3-145560
May 20, 1991 [JP] Japan ..... 3-145563

[51] Int. Cl.[5] ..... A24B 3/18

[52] U.S. Cl. ..... 131/291; 131/900; 131/901; 96/130

[58] Field of Search ..... 131/290-292, 131/298, 900-902; 426/445; 55/16, 338, 350, 211, 25-27

[56] References Cited

U.S. PATENT DOCUMENTS

Re. 32,014 10/1985 Sykes et al. .
3,575,178 4/1971 Stewart ..... 131/901 X
4,165,618 8/1979 Tyree ..... 131/291 X
4,253,474 3/1981 Hibbitts et al. .
4,258,729 3/1981 de la Burde et al. .
4,310,006 1/1982 Hibbitts et al. .
4,333,483 6/1982 de la Burde et al. .
5,020,550 6/1991 Uchiyama et al. .
5,076,293 12/1991 Kramer .
5,118,328 6/1992 Wnuk et al. ..... 55/16
5,137,547 8/1992 Chretien ..... 55/16
5,169,415 12/1992 Roettger et al. ..... 55/16 X

FOREIGN PATENT DOCUMENTS 0328676 2/1989 European Pat. Off. .

*Primary Examiner*—Vincent Millin
*Assistant Examiner*—J. Doyle

[57] ABSTRACT

An expanding apparatus continuously expands a material, e.g., a tobacco material and supplies gaseous carbon dioxide as an expanding agent to an impregnating vessel by an expanding agent supply to maintain a predetermined impregnating pressure. The material is continuously supplied to the impregnating vessel by a material supply while increasing the pressure of the material. The material is continuously discharged from the impregnating vessel by a material discharge while decreasing the pressure of the material. The expanding agent supply has a heat exchanger to perform heat exchange between carbon dioxide to be supplied to the impregnating vessel and a coolant, thereby cooling carbon dioxide. The state of carbon dioxide to be supplied to the impregnating vessel is controlled in accordance with the temperature or the like of the tobacco material discharged from the impregnating vessel, so that carbon dioxide is effectively impregnated and no dry ice is formed in the material discharge or the like.

3 Claims, 7 Drawing Sheets

EXPANDING APPARATUS FOR AGRICULTURAL PRODUCT SUCH AS TOBACCO MATERIAL

BACKGROUND OF THE INVENTION

1. Field of the Invention

The present invention relates to an expanding apparatus for expanding an agricultural product such as a tobacco material, or food. More particularly, the present invention relates to a continuous type expanding apparatus using gaseous carbon dioxide as an expanding agent, which has a cooling unit capable of reliably controlling at a low temperature the material transported from an impregnating vessel to a material discharge system and efficiently expanding the material.

2. Description of the Related Art

According to some conventional expanding apparatuses, the material, e.g., a tobacco material is impregnated with carbon dioxide as an expanding agent at a high pressure, and the tobacco material is pressure-decreased and heated, so that the impregnated carbon dioxide is expanded, thereby expanding the tobacco material.

The expanding apparatuses are classified into batch type expanding apparatuses and continuous type expanding apparatuses. In a batch type expanding apparatus, a predetermined amount of tobacco material is stored in an impregnating vessel, high-pressure carbon dioxide is supplied to the impregnating vessel to impregnate the tobacco material with carbon dioxide, and thereafter the tobacco material is removed, thereby expanding the tobacco material. In a continuous type expanding apparatus, the tobacco material and carbon dioxide are continuously supplied to an impregnating vessel.

Although the former batch type apparatus has a simple structure, its efficiency is low and a large amount of carbon dioxide is lost. The latter continuous type expanding apparatus is efficient and can recover and reutilize carbon dioxide.

In order to generally increase the expansion degree of the tobacco material or the like, the tobacco material must be brought into contact with carbon dioxide at a low temperature and a high pressure so that the material is impregnated with a maximum amount of carbon dioxide. The tobacco material impregnated with carbon dioxide must be removed from the impregnating vessel while maintaining the low temperature as much as possible, loss of impregnated carbon dioxide must be prevented, and the tobacco material must be heated instantaneously, thereby effectively expanding the impregnated carbon dioxide.

However, in the continuous type apparatus described above, the temperature and supply amount of the tobacco material supplied to the impregnating vessel, the quantity of external heat applied to this expanding apparatus, the quantity of frictional heat generated when the rotary valve is rotated, and the like vary over a considerably large range. Therefore, because of these variations in conditions, the temperature of the tobacco material supplied to the impregnating vessel is increased to decrease the impregnation amount of carbon dioxide, or the tobacco material removed from the impregnating vessel is heated while it passes through the rotary valve, and part of the impregnated carbon dioxide is lost, thereby decreasing the expansion degree.

In order to prevent these drawbacks, it is considered to cool and, if necessary, partly liquefy carbon dioxide to be supplied to the impregnating vessel in order to absorb heat generated in the material or in the components in the downstream of the impregnating vessel by the latent heat and sensible heat of carbon dioxide, thereby maintaining the material at a low temperature. However, if the cooling amount of carbon dioxide, i.e., the heat quantity to be removed is excessively small, the tobacco material or the components in the downstream of the impregnating vessel are not sufficiently cooled, not providing much effect. Inversely, if the cooling amount of carbon dioxide is excessively large, carbon dioxide is solidified to form dry ice while the tobacco material is pressure-decreased and discharged from its discharge system. When dry ice is formed in this manner, the tobacco material is solidified by it, causing a problem in the heating/expanding step. Furthermore, the amount of carbon dioxide discharged to the outside of the system together with the material is also increased, leading to an increase in loss of carbon dioxide. Such an operation to produce dry ice is not preferable in terms of economy and quality. Therefore, carbon dioxide must be impregnated in the impregnating vessel in a gaseous state. For this purpose, the cooling amount (heat exchange amount) of carbon dioxide to be supplied to the impregnating vessel must be appropriately controlled.

However, the temperature of tobacco material, the supply amount of tobacco material, the amount of external heat applied to the expanding apparatus, the heat quantity of the rotary valve, and the like are not stable and vary over a wide range. For this reason, it is difficult to impregnate the tobacco material with gaseous carbon dioxide with a preferable condition in the impregnating vessel.

In addition, control of the cooling amount (heat exchange amount) of carbon dioxide described above is generally considered to be performed by controlling the amount or temperature of carbon dioxide to be supplied. However, since the amount of carbon dioxide is determined to maintain the impregnating pressure in the impregnating vessel at a predetermined value, the above control cannot be performed. Regarding the temperature, since carbon dioxide is subjected to phase transition depending on the pressure and temperature, the temperature cannot be employed as a control factor. Accordingly, the cooling amount of carbon dioxide cannot be controlled by the amount or temperature of carbon dioxide.

SUMMARY OF THE INVENTION

It is an object of the present invention to provide an expanding apparatus capable of impregnating a material, e.g., a tobacco material with gaseous carbon dioxide in an impregnating vessel under a preferable condition.

In order to achieve the above object, according to the present invention, a heat exchanger is provided midway along a pipe of an expanding agent supply system in order to supply gaseous carbon dioxide as an expanding agent while maintaining a predetermined impregnating pressure, a coolant is supplied from a cooling mechanism to the heat exchanger, and a heat exchange amount of carbon dioxide to be supplied to the impregnating vessel is controlled by a control unit in accordance with various process amounts of this apparatus, e.g., a temperature (a temperature at which liquid carbon dioxide cannot exist) in a material discharge system, so that impregnation of gaseous carbon dioxide can be performed under a preferable condition.

In this apparatus, since the state of carbon dioxide to be supplied to the impregnating vessel is controlled by the process amount, e.g., the temperature of the discharge system through which the material is transported, even if the quantity of external heat applied to the apparatus, the heat generation quantity of a rotary valve, and the like vary, the apparatus can immediately cope with such variations.

As the process amount, the temperature of the tobacco material during discharge from the impregnating vessel, or the gas temperature of carbon dioxide discharged together with the tobacco material is used. Light or a radiation may be radiated on the tobacco material and carbon dioxide which are discharged, and their temperatures may be detected from the reflecting or transmitting spectra of the light or radiation. The heat exchange amount of carbon dioxide to be supplied to the impregnating vessel is automatically set based on the process amount so that the temperature of carbon dioxide and tobacco material in the impregnating vessel and other states will be optimum. This setting may not necessarily be performed automatically, and the heat exchange amount of carbon dioxide to be supplied to the impregnating vessel can be manually set by an operator based on the gas temperature of the tobacco material discharged from the impregnating vessel or of carbon dioxide discharged together with the tobacco material.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
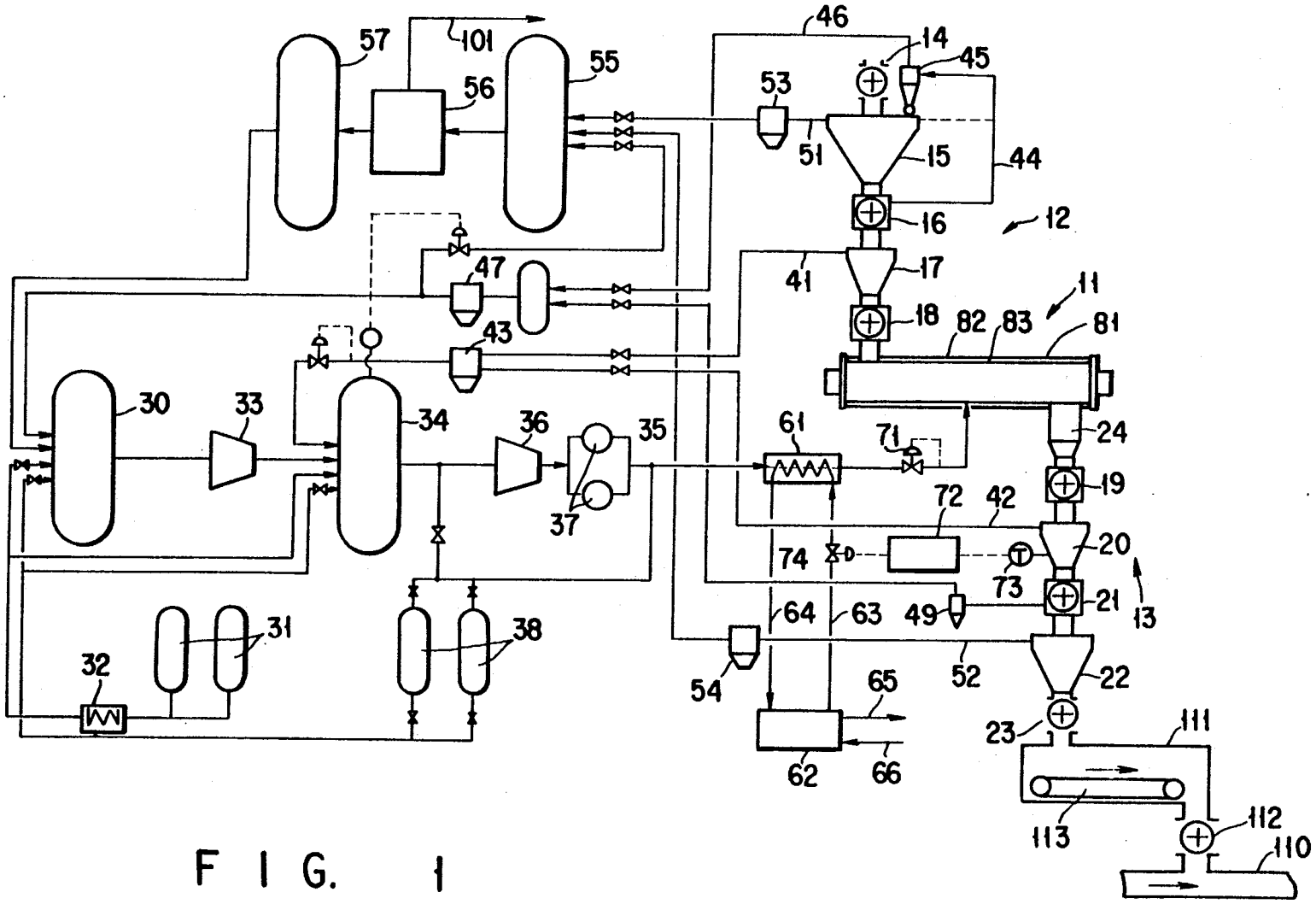
FIG. 1 is a schematic view showing an overall arrangement of an expanding apparatus according to the first embodiment of the present invention.

The preferred embodiments of the present invention will be described with reference to the accompanying drawings. FIGS. 1 to 5 show the first embodiment of the present invention which exemplifies a continuous type tobacco material expanding apparatus using carbon dioxide as the expanding agent. Referring to FIG. 1, reference numeral 11 denotes an impregnating vessel to which an expanding agent is supplied to maintain a predetermined pressure, e.g., carbon dioxide is supplied to maintain an impregnating pressure of about 30 atm. The tobacco material is continuously supplied from a material supply system 12 to the impregnating vessel 11. The tissues of the tobacco material are impregnated with carbon dioxide in the impregnating vessel 11.

The tobacco material impregnated with carbon dioxide is continuously transported to a heating unit (not shown) through a material discharge system 13 to contact high-temperature air or a high-temperature water vapor or a gas mixture of them in the heating unit. Then, carbon dioxide impregnated in the tobacco material is expanded, thereby expanding the tissues of the tobacco material.

Figure 2:
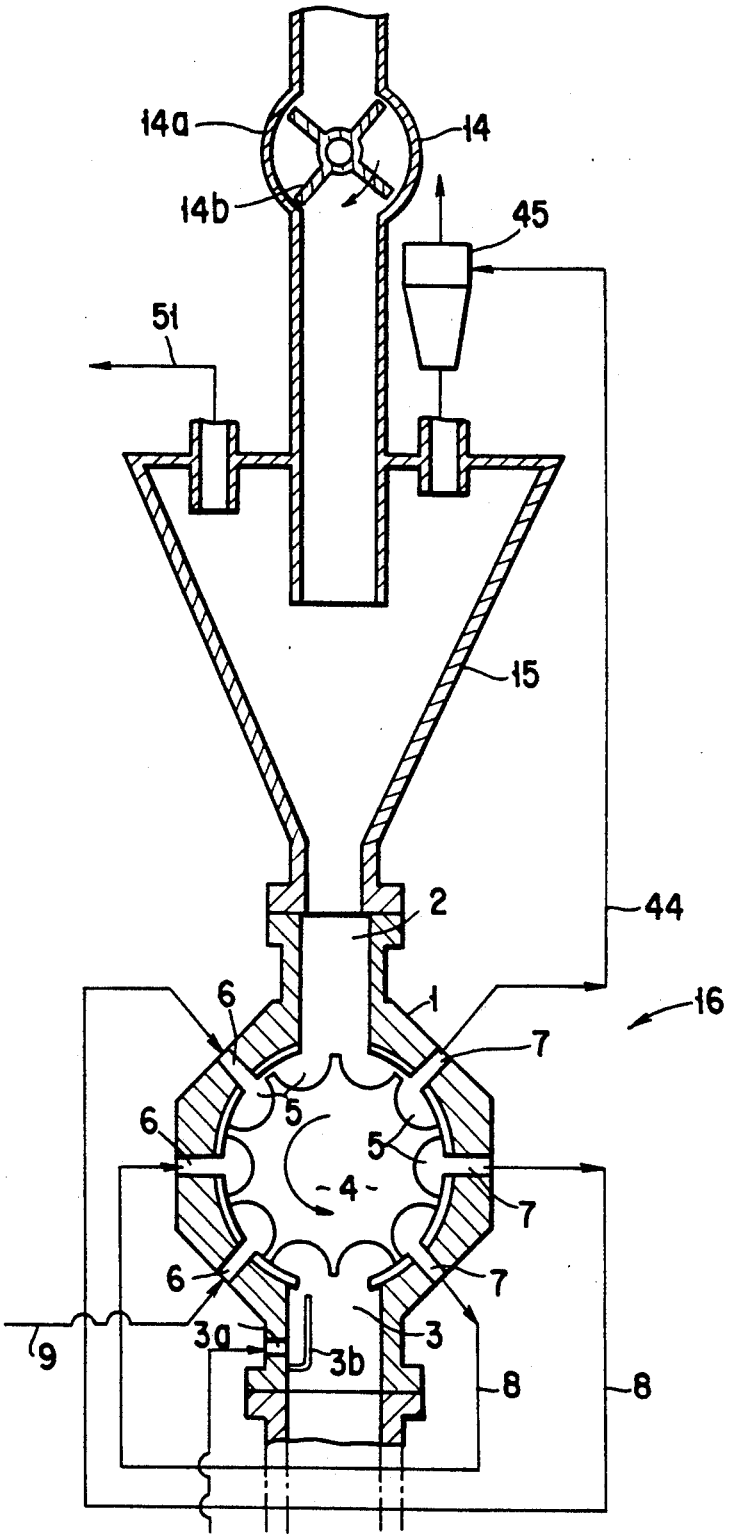
FIG. 2 is a partial sectional view of a rotary valve and a chute of FIG. 1.

The material supply system 12 described above has the following arrangement. The tobacco material is supplied to a first chute 15 through an air locker valve 14. In the air locker valve 14, a rotor **14*b* is rotatably provided in a housing 14*a*, as shown in FIG. 2, and a plurality of vanes are formed on the outer surface of the rotor 14*b*. The tobacco material supplied through the inlet port of the housing 14 is stored between the adjacent vanes and transported to the outlet of the housing 14 by the rotation of the rotor 14*b*. The distal end faces of these vanes and the inner surface of the housing 14 hermetically slidably contact each other. Accordingly, the inlet and outlet sides of the air locker valve 14 are sealed to maintain a pressure difference between them, so that the tobacco material can be continuously transported while increasing or decreasing the pressure. Low-pressure carbon dioxide of about an atmospheric pressure is supplied to the first chute 15**, and air contained in the tobacco material is substituted with this carbon dioxide.

Subsequently, the tobacco material is fed from the first chute 15 to a second chute 17 through a first rotary valve 16 while it is pressure-increased to an intermediate pressure of about 15 atm. The pressure in the second chute 17 is maintained at the intermediate pressure of about 15 atm.

The rotary valve 16 and the first chute 1 have the arrangements as shown in FIG. 2. Referring to FIG. 2, reference numeral 1 denotes a housing of the rotary valve 16. Supply and discharge ports 2 and 3 are formed in the housing 1. A rotating member 4 is rotatably, hermetically housed in the housing 1. A plurality of pockets 5 are formed on the outer surface of the rotating member 4. A plurality of pressure increase and decrease-side ports 6 and 7 are formed in the housing 1. The final-stage high-pressure port among the pressure increase-side ports 6 is connected to a carbon dioxide supply pipe 9, and carbon dioxide having a pressure of about 15 atm is supplied from the second chute 17. The final-stage low-pressure port among the pressure decrease-side ports 7 is connected to a carbon dioxide recovery pipe 44 so that pressure-decreased carbon dioxide is recovered. The remaining pressure increase and decrease-side ports 6 and 7 communicate with each other through corresponding communication pipes 8.

The inside of the supply port 2 is set at, e.g., an atmospheric pressure, and the inside of the discharge port 3 is set in a carbon dioxide atmosphere having a pressure of about 15 atm. The tobacco material charged into the supply port 2 through a hopper or the like is stored in the respective pockets 5 of the rotating member 4 and sequentially transported to the discharge port 3 as the rotating member 4 rotates.

Since the inside of the discharge port 3 is set in an intermediate-pressure carbon dioxide atmosphere, the interior of an empty pocket 5 which has opposed the discharge port 3 to discharge the tobacco material in it is set in the intermediate-pressure carbon dioxide atmosphere. While the pockets 5 sequentially oppose the pressure decrease-side ports 7, high-pressure carbon dioxide in each pocket 5 is sequentially discharged to the opposite pressure decrease-side port 7 to be pressure-decreased, e.g., about every 5 atm. Since the pressure decrease side ports 7 communicate with the pressure increase-side ports 6 through the communication pipes 8, carbon dioxide discharged into the respective pressure decrease-side ports 7 is supplied to the corresponding pressure increase-side ports 6. Accordingly, while each pocket 5 storing the tobacco material sequentially opposes each pressure increase-side port 6, carbon dioxide in this pocket 5 is pressure-increased, e.g., every 5 atm. When each pocket 5 opposes the final-stage pressure increase-side port 6, carbon dioxide in this pocket 5 is pressure-increased to the same pressure as that of the inside of the discharge port 3. Then, this pocket 5 opposes the discharge port 3 to discharge the tobacco material stored in it through the discharge port 3.

When the empty pocket 5 opposes the final-stage pressure decrease-side port 7, low-pressure carbon dioxide remaining in the pocket 5 is recovered from the pressure decrease-side port 7 through the carbon dioxide recovery pipe 44, and the interior of the pocket 5 is restored to the atmospheric pressure.

A nozzle wall 3*b* is provided in the discharge pipe 3, and an injection port 3*a* is formed to communicate with the gap between the nozzle wall 3*b* and the inner surface of the discharge port 3. High-pressure carbon dioxide is supplied through the injection port 3*a* to inject high-pressure carbon dioxide from the gap defined by the nozzle wall 3*b* and the inner surface of the discharge port 3 into the empty pocket 5 from which the tobacco material has been discharged, thereby removing the tobacco material remaining in the pocket 5 by the injection flow.

The above description exemplifies a rotary valve for continuously supplying the tobacco material while increasing its pressure. However, the pressure decrease-side rotary valves for discharging the tobacco material while decreasing its pressure have the same structure as described above and perform pressure increase and decrease operations in the opposite manner.

The first chute 15 constitutes a hermetic vessel, and the tobacco material is supplied to it from its upper portion through the air locker valve 14. The carbon dioxide recovery pipe 44 is connected to the final-stage pressure decrease-side port 7 of the rotary valve 16, and the pipe 44 communicates with the first chute 15 through a cyclone 45. Accordingly, when carbon dioxide is discharged from the final-stage pressure decrease-side port 7, a small amount of tobacco material contained in it is removed by the cyclone 45, and thereafter carbon dioxide is recovered through a pipe 46.

Part of carbon dioxide supplied through the pipe 44 is supplied to the first chute 15 together with the separated tobacco material. Accordingly, the interior of the first chute 15 is maintained at a carbon dioxide atmosphere, and air contained in the tobacco material supplied through the air locker valve 14 is substituted with carbon dioxide and flow a few air to the side of the impregnating vessel 11. Note that carbon dioxide supplied to the first chute 15 and mixed with air i recovered through a pipe 51.

The tobacco material is pressure-increased to a high pressure of about 30 atm through the second chute 17 and a second rotary valve 18 and supplied to the impregnating vessel 11. Carbon dioxide is supplied to the impregnating vessel 11 in order to maintain its interior at a pressure of about 30 atm, as described above. The impregnating vessel 11 has a cylindrical shape. A screw conveyor (not shown) is provided in the impregnating vessel 11 to feed the tobacco material supplied to it to the outlet port.

The material discharge system 13 has the following arrangement. The tobacco material discharged from an outlet port 24 of the impregnating vessel 11 is pressure-decreased to an intermediate pressure of about 15 atm by a third rotary valve 19 and supplied to a third chute 20. The interior of the third chute 20 is maintained at an intermediate pressure of about 15 atm.

Then, the tobacco material is pressure-decreased to a low pressure by the third chute 20 and a fourth rotary valve 21 and supplied to a fourth chute 22. The interior of the fourth chute 22 is maintained at a low pressure, i.e., an atmospheric air pressure. The tobacco material is supplied from the fourth chute 22 to the heating mechanism (described above) through an air locker valve 23 to be heated and expanded.

The heating mechanism has an expansion column 110, and a gas mixture of air and superheated water vapor having a predetermined temperature flows through the expansion column 110. While the tobacco material supplied in the expansion column 110 floats in the flow of the gas mixture and transported together with the gas mixture, it is heated by the high-temperature gas mixture and expanded. The expanded tobacco material is separated from the gas mixture by a conventionally known tangential separator or the like and recovered.

An intermediate vessel 111 is provided between the fourth chute 22 and the expansion column 110. The intermediate vessel 111 is arranged substantially horizontally and having one end portion coupled to the fourth chute 22 through the air locker valve 23. The other end portion of the intermediate vessel 111 is coupled to the expansion column 110 through an air locker valve 112. A conveyor 113 is disposed in the intermediate vessel 111 to extend in the horizontal direction.

The tobacco material discharged from the fourth chute 22 drops into the one end portion of the intermediate vessel 111 through the air locker valve 23, transported horizontally by the conveyor 113, and drops into the expansion column 110 from the other end portion of the intermediate vessel 111 through the air locker valve 112. Since the air locker valve 23 at one end portion of the intermediate vessel 111 and the air locker valve 112 at the other end portion of the intermediate vessel 111 are offset in the horizontal direction, the high-temperature mixture gas rising from the expansion column 110 does not directly rise up to the lower portion of the fourth chute 22, so that the gas mixture is prevented from flowing into the fourth chute 22.

Recovery and supply systems of the expanding agent of this expanding apparatus, i.e., carbon dioxide will be described. Referring to FIG. 1, reference numeral 30 denotes a low pressure tank. Recovered low-pressure carbon dioxide is finally recovered in the low-pressure tank 30. Reference numeral 31 denotes a carbon dioxide supply source, e.g., a liquid carbon dioxide tank. Carbon dioxide in the tank 31 is gasified through an evaporator 32 and supplied to the low-pressure tank 30.

Carbon dioxide in the low-pressure tank 30 is pressure-increased to an intermediate pressure of about 5 to 15 atm by a low-pressure booster 33 and supplied to an intermediate-pressure tank 34. Carbon dioxide in the intermediate-pressure tank 34 is pressure-increased by a high-pressure booster 36 to a pressure slightly higher than the impregnating pressure. The moisture of carbon dioxide is removed by a dehydrator 37, and carbon dioxide is supplied to the impregnating vessel 11 through a supply pipe 35.

Intermediate-pressure carbon dioxide recovered from the second and third chutes 17 and 20 is recovered in the intermediate-pressure tank 34 through pipes 41 and 42 and a bag filter 43. Low pressure carbon dioxide discharged from the first rotary valve 16 is supplied to a separator 45 through a pipe 44. After the tobacco material powder mixed in this carbon dioxide is separated, carbon dioxide is recovered in the low-pressure tank 30 through a pipe 46 and a bag filter 47. Low-pressure carbon dioxide discharged from the fourth rotary valve 21 is supplied to a separator 49 to separate the tobacco material powder from it and recovered in the low-pressure tank 30 through said bag filter 47.

Since air and/or impurity gas are mixed in low-pressure carbon dioxide recovered from the first chute 15 at the start end portion and the fourth chute 22 at the terminal end portion, this carbon dioxide is recovered in a separation/recovery tank 55 through the pipe 51, a pipe 52, and bag filters 53 and 54. Carbon dioxide recovered in the separation/recovery tank 55 is supplied to a separation unit 56. After mixed air and other impurity gases are separated, this carbon dioxide is recovered in the low-pressure tank 30 through a separation serge tank 57.

Figure 3:
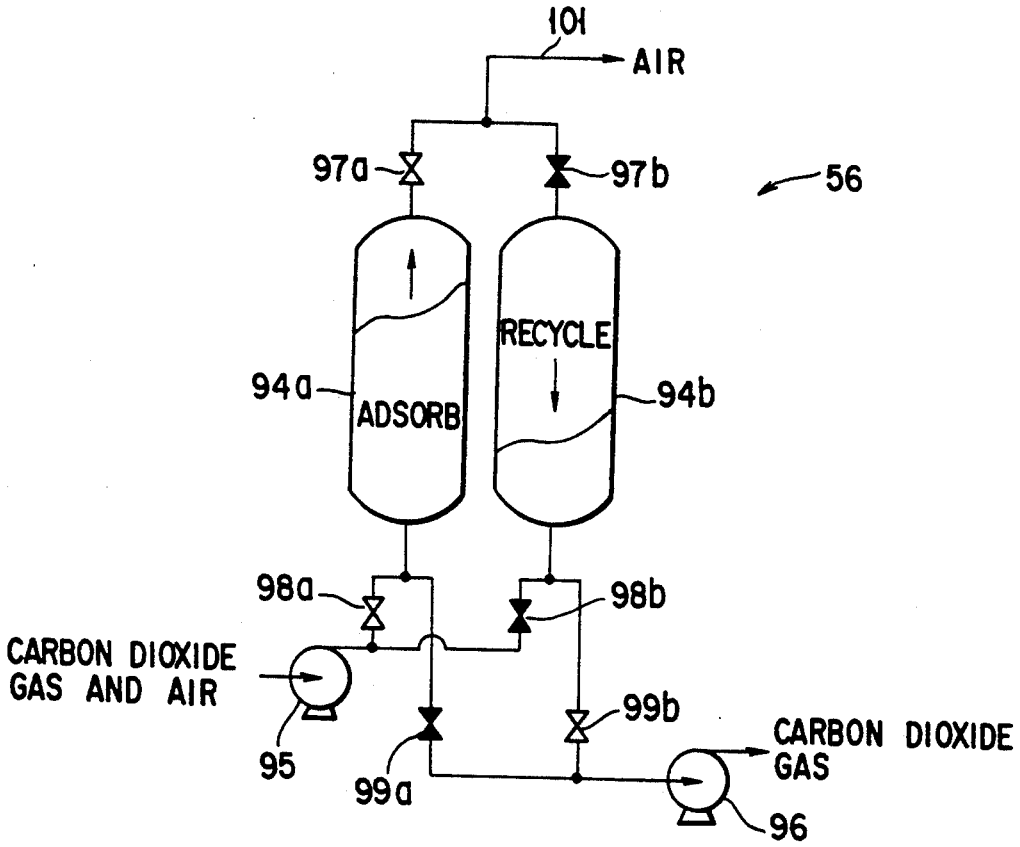
FIG. 3 is a schematic diagram of a carbon dioxide recovery/separation unit.
Figure 4:
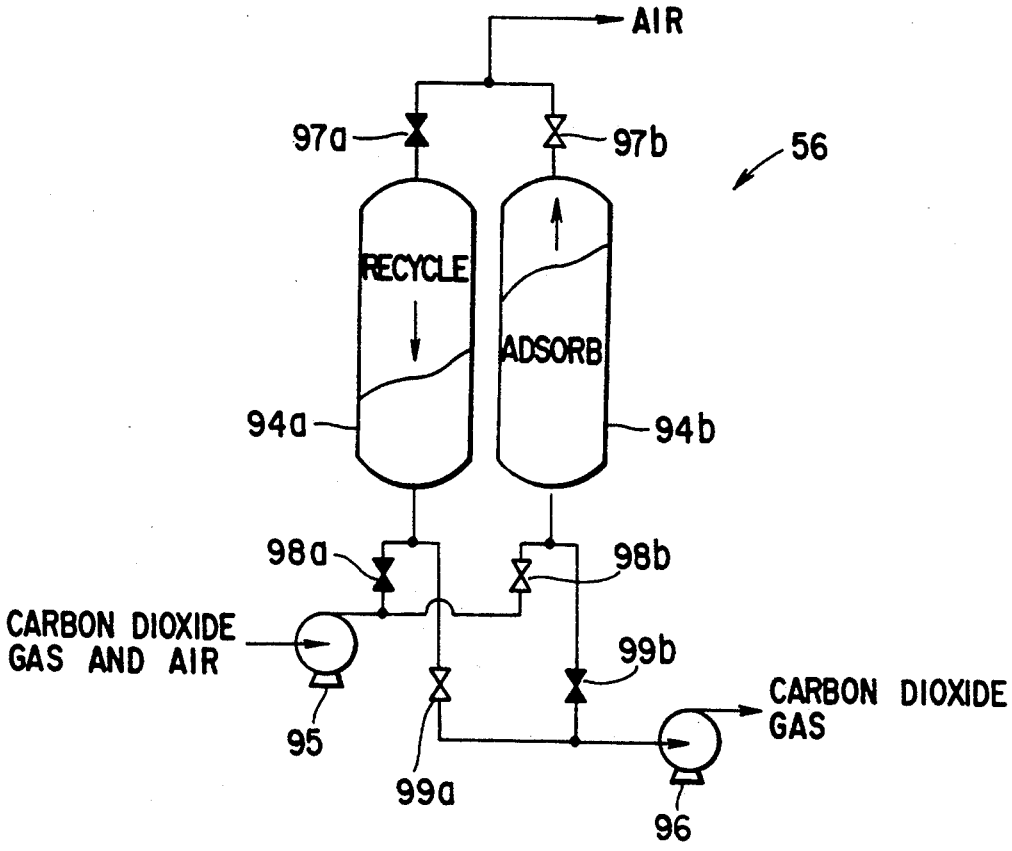
FIG. 4 is a schematic diagram of the carbon dioxide recovery/separation unit.
Figure 5:
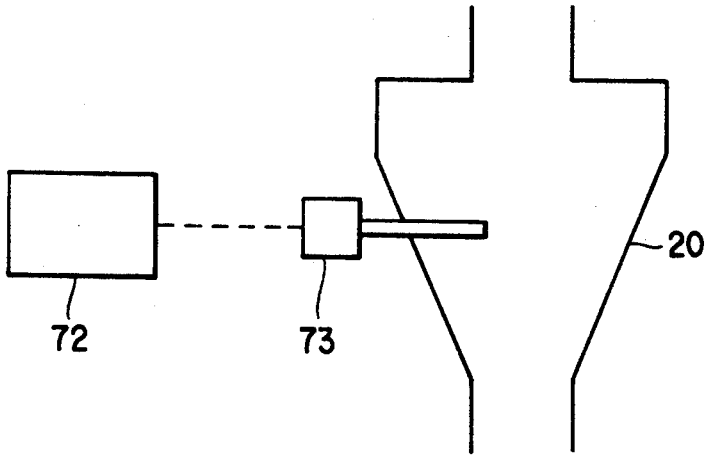
FIG. 5 is a schematic diagram of a process amount detecting means.

FIGS. 3 and 4 show this recovery/separation unit 56. The recovery/separation unit 56 is an adsorption type carbon dioxide separation unit. More specifically, as shown in FIGS. 3 and 4, a plurality of adsorption towers, e.g., two adsorption towers 94*a* and 94*b* are provided in the recovery/separation unit 56. An adsorbent such as activated charcoal or zeolite is filled in the adsorption towers 94*a* and 94*b*. Each of these adsorbents selectively adsorbs carbon dioxide from a gas mixture containing air and carbon dioxide, and the higher the pressure, the larger the adsorption amount; the lower the pressure, the smaller the adsorption amount.

The recovery/separation unit 56 also has a pressure pump 95 and a vacuum pump 96 each connected to one end portion of each of the adsorption towers 94*a* and 94*b* through valves 98*a* and 98*b*, or valves 99*a* and 99*b*. The other end portion of each of the adsorption towers 94*a* and 94*b* is connected to a discharge pipe 101 through a corresponding one of valves 97*a* and 97*b*.

In the recovery/separation unit 56, the valves 98*a* and 97*a* of one adsorption tower 94*a* are opened, and the gas mixture containing carbon dioxide and air which is supplied from the hermetic vessels 15 and 22 is supplied to the adsorption tower 94*a* by the pressure pump 95 so that carbon dioxide is adsorbed by the adsorption tower 94*a*. The remaining gas, e.g., air and impurity gas are separated from carbon dioxide and are discharged to the outside through the discharge pipe 101. At this time, the valves 98*b* and 97*b* of the other adsorption tower 94*b* and the valve 99*a* of tower 94*a* are closed, the valve 99*b* is open, and the interior of the other adsorption tower 94*b* is evacuated to a low pressure by the vacuum pump 96. As a result, carbon dioxide adsorbed in the adsorbent in the other adsorption tower 94*b* is released, recovered, and returned to the system of the expanding apparatus described above.

Then, as shown in FIG. 4, the valves 98*a* and 97*a* of one adsorption tower 94*a* are closed and the valves 98*b* and 97*b* of the other adsorption tower 94*b* are opened, in the opposite manner to that described above, to set the interior of one adsorption tower 94*a* at a low pressure, so that carbon dioxide adsorbed in the adsorbent in the adsorption tower 94*a* is released and recovered while carbon dioxide is adsorbed in the other adsorption tower 94*b* This operation is repeated to alternately cause the adsorption towers 94*a* and 94*b* to perform adsorption, thereby separating and recovering carbon dioxide. This cycle is repeated every comparatively short period of, e g., 90 to 180 sec.

With the recovery/separation unit 56 having the above arrangement, carbon dioxide containing air can be recovered, air is efficiently removed, and only carbon dioxide can be separated, recovered, and returned to the system of the expanding apparatus. Therefore, carbon dioxide will not be discharged and wasted to the outside, and the concentration of carbon dioxide in the system can be precisely controlled.

Since the recovery/separation unit 56 separates carbon dioxide by adsorption, it can separate even carbon dioxide which has a low concentration. In addition, the recovery/separation unit 56 has a good response characteristic and can stably control the concentration of carbon dioxide in the carbon dioxide circulating system of this expanding apparatus.

A unit for controlling the heat exchange amount of carbon dioxide supplied to the impregnating vessel 11 will be described. A heat exchanger 61 is provided midway along the supply pipe 35 for supplying to the impregnating vessel 11 carbon dioxide which is pressure-increased to a pressure slightly higher than the impregnating pressure by the high-pressure booster 36. A cooling mechanism 62 comprises a freezer and a heat exchanger (not shown) to supply a low-temperature brine. The brine circulates in the heat exchanger 61 through brine pipes 63 and 64 to cool carbon dioxide supplied to the system.

A control unit 72 for controlling the heat exchange amount of carbon dioxide is provided. The control unit 72 detects the process amount of the expanding apparatus, e.g., the temperature in the third chute 20 by a temperature detector 73 and determines the heat exchange amount of carbon dioxide to be supplied to the impregnating vessel 11 in accordance with the temperature signal from the temperature detector 73. A program based on data obtained by analyzing the characteristics of the expanding apparatus in advance through tests is stored in the control unit 72, and the control unit 72 determines the heat exchange amount of carbon dioxide in accordance with this program. The control unit 72 sends a control signal to a control valve 74 connected midway along the brine pipe 63 to control the heat exchange amount of carbon dioxide to be supplied to the impregnating vessel 11.

For example, when the impregnating pressure is about 30 atm, the interior of the third chute 20 is maintained at about 15 atm. The heat exchange amount (cooling amount) of carbon dioxide to be supplied to the impregnating vessel 11 is controlled so that the temperature in the chute 20 is set at a value higher than the saturation temperature (about −28° C.), preferably −10° to −25° C. and more preferably −18° to −23° C.

In the controlled state as described above, the impregnated amount of carbon dioxide of the material discharged from the impregnating process under an atmospheric pressure is 1 to 3% DB (Dry Base). At this time, the temperature of the material is −20° to −40° C., no dry ice is formed, and loss of carbon dioxide can be minimized. Also, material dispersion is good in the following expanding drying process to obtain a sufficient expanding effect.

The impregnating vessel 11 employs a heat-insulating structure in order to decrease and stabilize the quantity of external heat applied to the apparatus. This heat-insulating structure is constituted by a vacuum heat-insulated vessel 81 disposed to surround the outer surface 83 of the impregnating vessel 11. The vacuum heat-insulated vessel 81 has outer walls 82. The outer walls 82 constitute a hermetic structure, and the gap between the walls 82 is evacuated to a vacuum state.

The function of the expanding apparatus described above will be described. Carbon dioxide to be supplied to the impregnating vessel 11 is cooed in the heat exchanger 61 by a brine having a temperature lower than its saturation temperature. Cooled carbon dioxide contacts the tobacco material moved in the impregnating vessel 11 and cools the tobacco material, thereby allowing effective carbon dioxide impregnation.

The temperature and supply amount of the tobacco material supplied to the impregnating vessel 11, the quantity of external heat applied to the impregnating vessel 11, the heat generation quantity of the rotary valve, and the like vary over a considerable range. In this case, the appropriate heat exchange amount described above varies due to the variations in these factors. When such a heat quantity varies, however, the process amount of the expanding apparatus, i.e., the temperature in the third chute 20 is changed. This change in temperature is detected by the temperature detector 73. In response to this temperature change, the control unit 72 controls the control valve 74 in accordance with the installed program, thereby controlling the heat exchange amount of carbon dioxide to be supplied to the impregnating vessel 11. Hence, the cooling amount of carbon dioxide is always controlled to an appropriate value in response to the change in heat quantity. As a result, a preferable impregnating condition for gaseous carbon dioxide is set.

Figure 6:
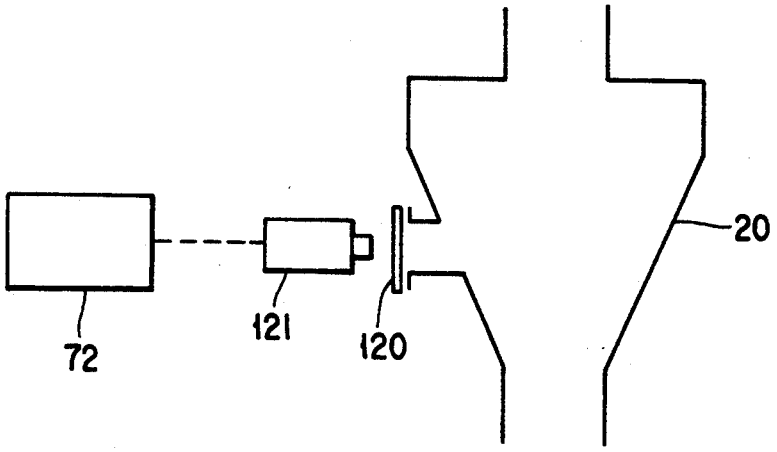
FIG. 6 is a schematic diagram of another modification of the process amount detecting means.

FIG. 6 shows another modification for detecting the process amount. In this modification, a light-transmitting window 120 is formed in part of the wall of the third chute 20, and light emitted by the tobacco material inside the chute 20 is detected by a photo-detector 121 through the window 120. The photodetector 121 detects the temperature of the tobacco material from the spectral distribution of the light emitted by the tobacco material. A signal representing the temperature of the tobacco material is sent to the control unit 72.

Figure 7:
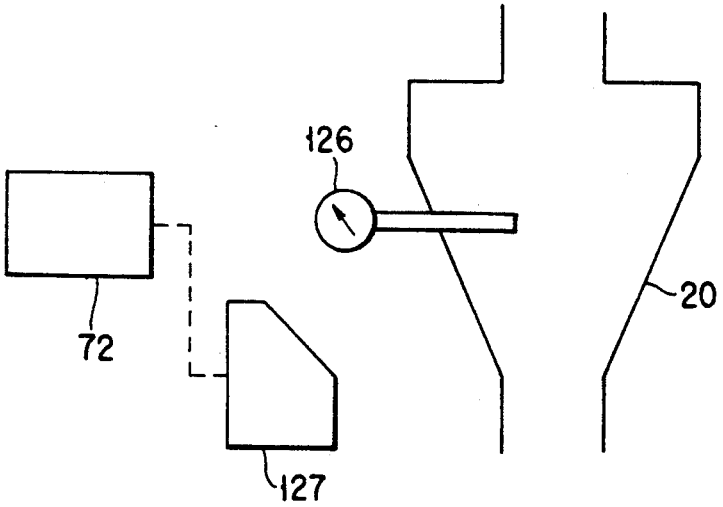
FIG. 7 is a schematic diagram of still another modification of the process amount detecting means.

FIG. 7 shows another modification for detecting and controlling the process amount. In this modification, a visual thermometer 126 is mounted on a chute 20. The operator manually operates an operation panel 127 on the basis of the value of the thermometer 126 to control the heat exchange amount of carbon dioxide to be supplied to the impregnating vessel 11.

Figure 8:
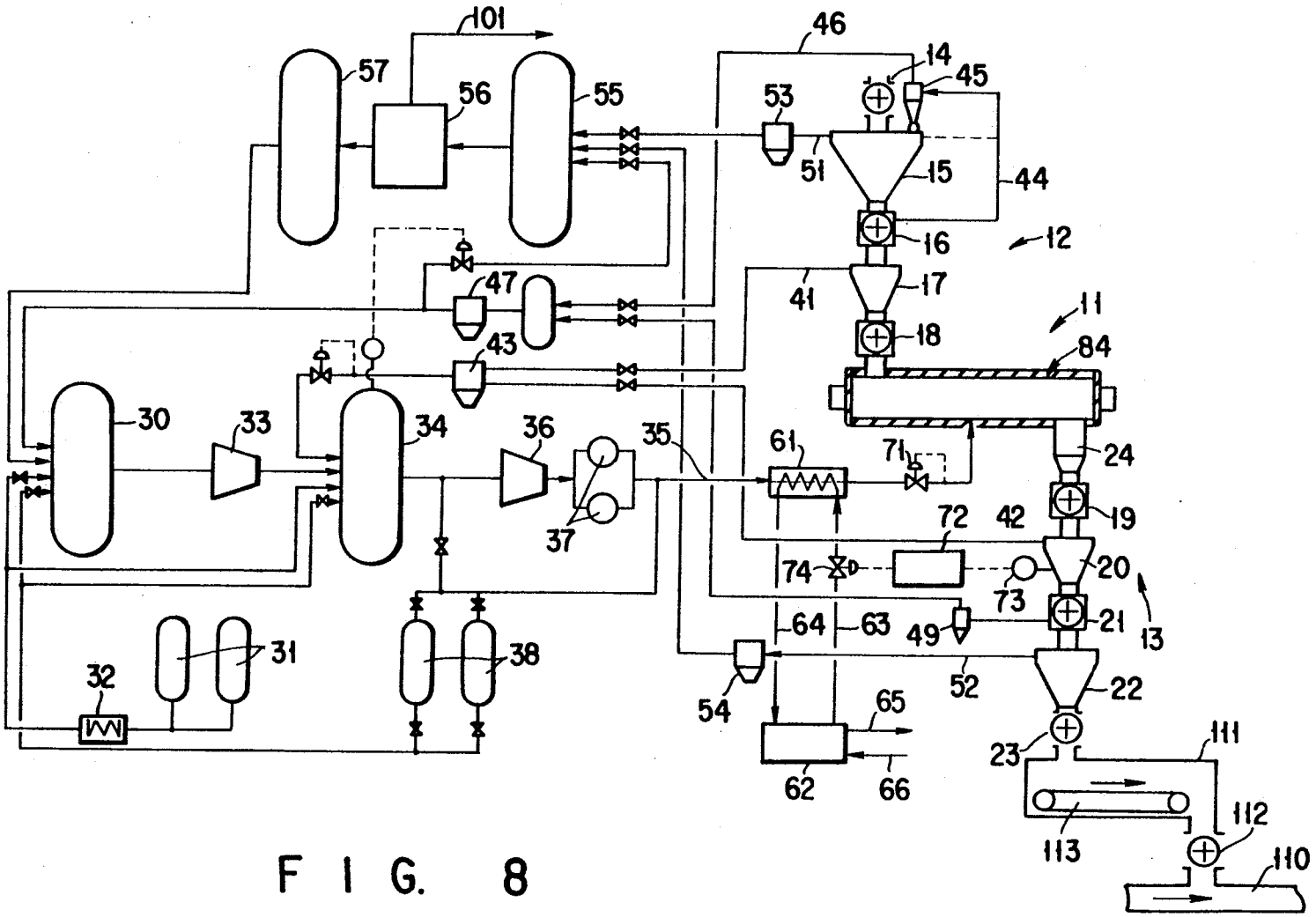
FIG. 8 is a schematic diagram showing an overall arrangement of an expanding apparatus according to the second embodiment of the present invention.

FIG. 8 shows an expanding apparatus according to the second embodiment of the present invention. In the second embodiment, an impregnating vessel 11 is surrounded by a heat-insulating material 84. In this case, although the heat-insulating effect is slightly degraded as compared to the vacuum vessel, the manufacturing cost is low. Even when this impregnating vessel 11 is employed, if carbon dioxide is circulated prior to the operation of the apparatus, the impregnating vessel 11 is stabilized at a predetermined temperature, and no problem occurs in operation. Excluding this, the second embodiment has the same arrangement as the first embodiment described above. In FIG. 8, the corresponding portions are denoted by the same reference numerals, and a detailed description thereof has been omitted.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An expanding apparatus for continuously expanding an agricultural material comprising:

an impregnating vessel;

an expanding agent supply means for supplying carbon dioxide as an expanding agent to said impregnating vessel, the expanding agent supply means maintaining a predetermined impregnating pressure;

material supply means for continuously supplying the material to said impregnating vessel, the material supply means increasing a pressure of the material;

material discharge means for continuously discharging the material from said impregnating vessel, the material discharge means decreasing the pressure of the material;

said expanding agent supply means comprises:

a heat exchanger for cooling carbon dioxide by performing heat exchange between carbon dioxide and a coolant before the carbon dioxide is supplied to said impregnating vessel;

cooling means for cooling said coolant to said heat exchanger; and control means for controlling a heat exchange amount to the carbon dioxide before the carbon dioxide is supplied to said impregnating vessel, said control means detects a temperature of gaseous carbon dioxide or material in said material discharge means, and controls the heat exchange amount to the carbon dioxide before the carbon dioxide is supplied to said impregnating vessel in accordance with the detected temperature, thereby controlling the heat exchange amount.

2. The apparatus according to claim 1, further comprising carbon dioxide recovery/separation means for separating at least one of air and an impurity gas from carbon dioxide recovered from said material supply means and said material discharge means.

3. The apparatus according to claim 1, further comprising carbon dioxide recovery/systems for separately recovering low-pressure carbon dioxide and intermediate-pressure carbon dioxide from said material supply means and said material discharge means and increasing pressures of low-pressure carbon dioxide and intermediate-pressure carbon dioxide to a high pressure.

* * * * *